US010368642B2

(12) United States Patent
Wise

(10) Patent No.: US 10,368,642 B2
(45) Date of Patent: Aug. 6, 2019

(54) RECLINING CHAISE LOUNGE

(71) Applicant: Robert Wise, Penngrove, CA (US)

(72) Inventor: Robert Wise, Penngrove, CA (US)

( * ) Notice: Subject to any disclaimer, the term of this patent is extended or adjusted under 35 U.S.C. 154(b) by 0 days.

(21) Appl. No.: 15/448,030

(22) Filed: Mar. 2, 2017

(65) Prior Publication Data

US 2018/0249836 A1 Sep. 6, 2018

(51) Int. Cl.

| | |
|---|---|
| ***A47C 1/14*** | (2006.01) |
| ***A47C 4/00*** | (2006.01) |
| ***A47C 7/50*** | (2006.01) |
| ***A47C 7/54*** | (2006.01) |
| ***A47C 7/66*** | (2006.01) |
| ***A47C 7/68*** | (2006.01) |

(52) U.S. Cl.

CPC ..... *A47C 1/143* (2013.01); *A47C 4/00* (2013.01); *A47C 7/506* (2013.01); *A47C 7/543* (2013.01); *A47C 7/66* (2013.01); *A47C 7/68* (2013.01)

(58) Field of Classification Search

CPC ..... A47C 4/00; A47C 7/506; A47C 7/543; A47C 7/66; A47C 7/68; A47C 1/143

USPC ..... 297/31, 354.13, 377, 354.11, 359, 358, 297/900

See application file for complete search history.

(56) References Cited

U.S. PATENT DOCUMENTS 523,903 A * 7/1894 McPhee et al. ..... A47C 1/035 297/27
1,462,005 A * 7/1923 Hall ..... A47C 1/143 297/23
1,902,249 A * 3/1933 Lanzy ..... A47C 20/045 297/377
2,571,139 A * 10/1951 Johnson ..... A47C 1/146 297/377
2,666,216 A * 1/1954 Schnaitter ..... A47C 20/027 5/634
2,783,824 A * 3/1957 Rechler ..... A47C 1/026 297/360
2,812,013 A * 11/1957 Tadeusz ..... A47C 1/0265 297/359
2,847,060 A * 8/1958 Pearlstine ..... A47C 1/0265 297/359
3,032,373 A * 5/1962 Danciart ..... A47C 1/026 297/371
3,186,757 A * 6/1965 Hopkins ..... A47C 4/50 297/28

(Continued)

*Primary Examiner* — Theodore V Adamos

(74) *Attorney, Agent, or Firm* — Global Intellectual Property Agency, LLC; Daniel Boudwin

(57) ABSTRACT

A reclining chaize lounge for resting. The reclining chaize lounge includes a base frame having a front leg and a rear leg, a seat panel and a back panel. The back panel is hingedly secured to the base frame via a seat reclining mechanism that is configured to adjust the angle of the back panel relative to the seat panel and bias the back panel toward a forward position. Two support members connect the back panel to a track having recessed notches disposed along the base frame. When a lever is engaged, the recessed notches disengage, allowing the support members, and thus the back member, to easily adjust position. If no pressure is applied to the back panel when the lever is engaged, a spring mechanism automatically pushes the back panel toward a forward position. A canopy affixed to the back panel is provided for sun protection.

23 Claims, 8 Drawing Sheets

(56) References Cited

U.S. PATENT DOCUMENTS 3,800,338 A * 4/1974 Smith ..... A61G 7/015 297/377
4,043,592 A * 8/1977 Fries ..... A47C 7/402 297/291
4,445,661 A * 5/1984 Langmesser, Jr. ... B60N 2/1803 248/394
5,029,349 A * 7/1991 Hamilton ..... A47C 1/143 5/111
5,310,246 A * 5/1994 Tseng ..... A47C 1/0265 297/28
5,388,892 A * 2/1995 Tornero ..... A47C 1/03 248/409
5,833,310 A * 11/1998 Labelle ..... A47C 7/66 135/96
5,947,561 A * 9/1999 Ryan ..... A47C 1/143 297/183.5
6,068,342 A * 5/2000 Mariani ..... A47C 1/143 297/188.01
6,382,727 B1 * 5/2002 Pickard ..... A47C 7/506 297/30
6,578,857 B1 * 6/2003 Whiteside ..... B25H 5/00 280/32.5
6,979,056 B1 * 12/2005 Goldszer ..... A47C 1/0265 297/184.1
7,025,421 B1 * 4/2006 Fowler ..... A47C 1/026 297/325
7,275,273 B2 * 10/2007 Lary ..... A47C 20/021 297/377
7,493,667 B2 * 2/2009 Ferko, III ..... A61G 7/015 297/354.13
D731,800 S * 6/2015 Wise ..... D6/361
2006/0005313 A1 * 1/2006 Fluellen ..... A47C 17/66 5/638
2006/0255634 A1 * 11/2006 Gallo ..... A47C 1/143 297/220
2009/0127909 A1 * 5/2009 Caldwell ..... A47C 1/143 297/354.12
2010/0176639 A1 * 7/2010 Balgaard ..... A47C 1/146 297/354.13
2011/0285182 A1 * 11/2011 Wilson ..... A47C 1/024 297/35
2013/0214565 A1 * 8/2013 Nickell ..... A47C 1/143 297/30

* cited by examiner

RECLINING CHAISE LOUNGE

BACKGROUND OF THE INVENTION

The present invention relates to lounge chairs. More specifically, the present invention relates to reclining lounge chairs that feature a reclining mechanism for a back panel that easily engages and disengages.

Lounge chairs are ubiquitous sights along pools and beach fronts, offering comfortable reclined seating for individuals wishing to relax and enjoy the outdoors. Many of these chairs offer the ability to adjust the angle of tilt of a back panel relative to a seat panel, allowing users to choose a comfortable and desired position while seated in the chair. However, many of the currently available options include a number of disadvantages.

Some lounge chairs are particularly cumbersome to adjust, often requiring a user to get up off the chair in order to adjust the angle of the back panel. A user must manually lift the back panel, move a supporting arm into a desired receiving element, and then go back and lie down in the chair. This procedure often requires a user to do this multiple times in order to achieve the desired positioning, which is frustrating and can detract from the goal of relaxation.

Additionally, some lounge chairs fail to provide arm rests, making them uncomfortable for a user to read or to perform other activities. While some chairs provide arm rests, many fail to adjust the arm rest position with the reclined angle of the back panel. This can lead to arm rests that are too elevated, making them practically unusable. Furthermore, a user often has to provide their own means of sun protection, which can make the lounge chair experience less than ideal.

SUMMARY OF THE INVENTION

In view of the foregoing disadvantages inherent in the known types of lounge chairs now present in the prior art, the present invention provides a lounge chair wherein the same can be utilized for providing convenience for a user when desiring to use a chair that can have the angle of a back panel easily adjustable. The present system comprises a base frame having a front leg and a rear leg, where a seat panel is secured to a front portion of the base frame. A back panel is hingedly secured to the base frame at an intermediate position via a seat reclining mechanism that is configured to adjust the angle of the back panel relative to the seat panel and bias the back panel toward a forward position. Two support members connect the back panel with a track having recessed notches disposed along the base frame. When a lever is engaged, the recessed notches disengage, allowing the support members, and thus the back member, to easily adjust. If no pressure is applied to the back panel when the lever is engaged, a spring mechanism automatically pushes the back panel toward a forward position. A canopy affixed to the back panel is provided for sun protection.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
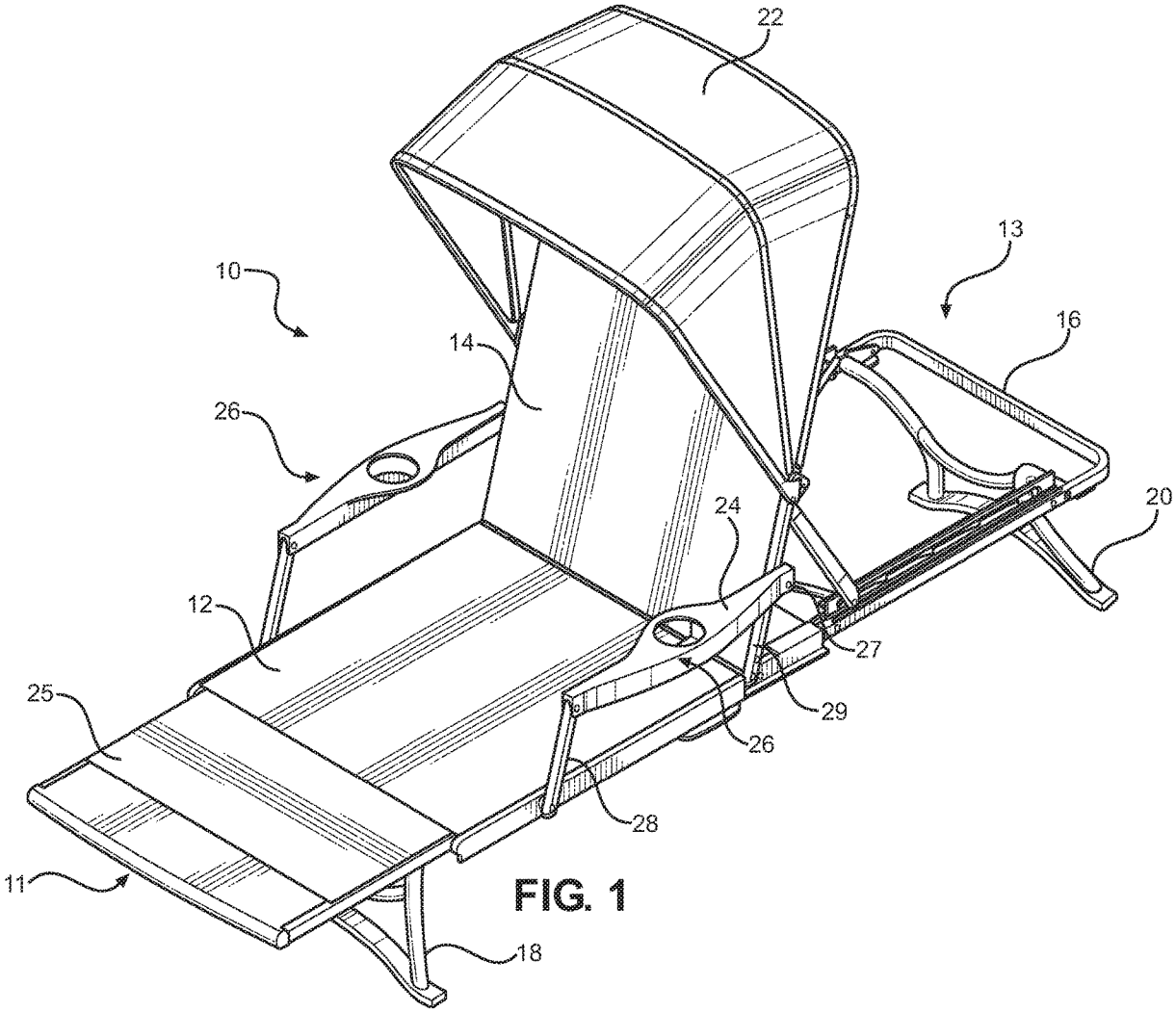
FIG. 1 shows a perspective view of the reclining chaise lounge with the back panel in an upright position.

Reference is made herein to the attached drawings. Like reference numerals are used throughout the drawings to depict like or similar elements of the reclining chaise lounge. The figures are intended for representative purposes only and should not be considered to be limiting in any respect.

Figure 2:
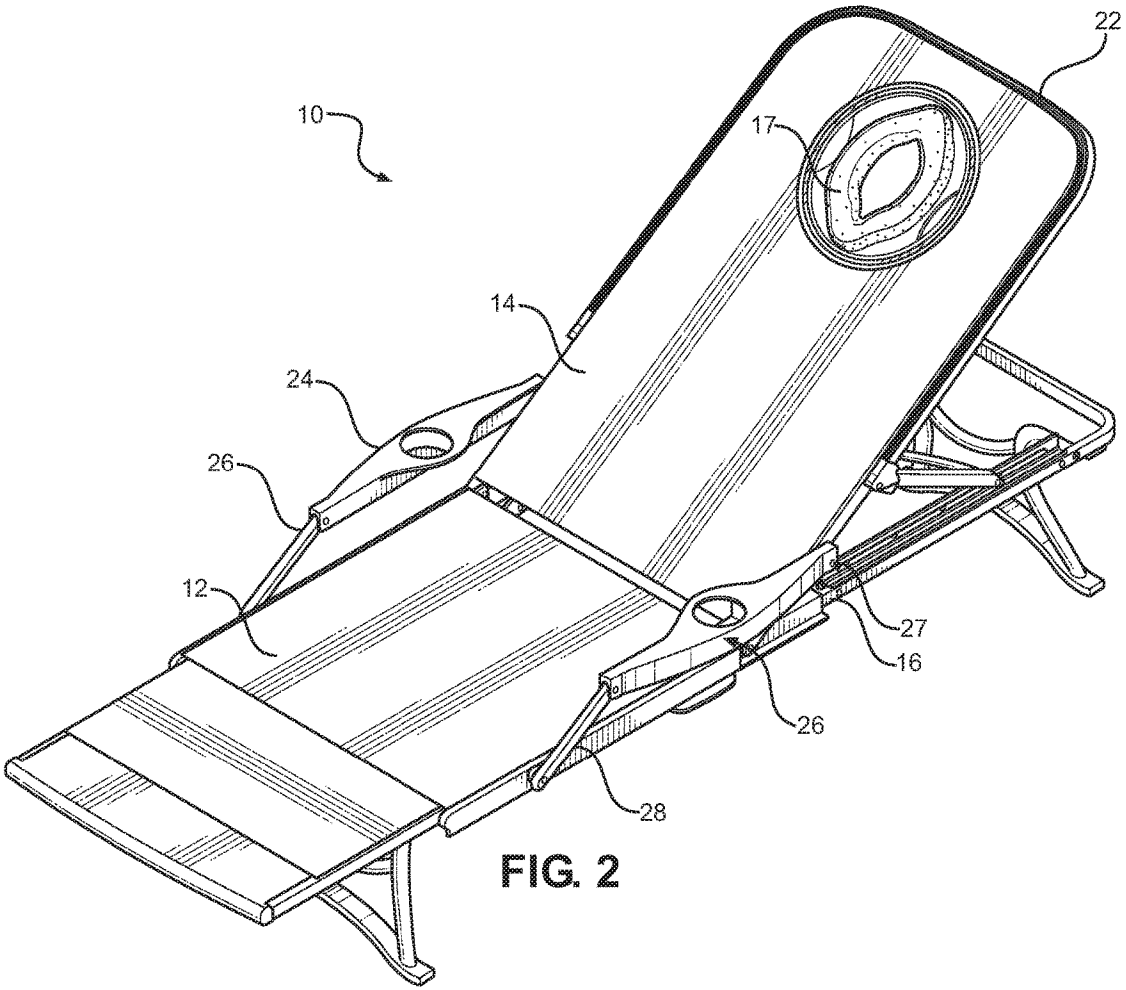
FIG. 2 shows a perspective view of the reclining chaise lounge with the back panel in a reclined position.

Referring now to FIGS. 1 and 2, there is shown a perspective view of the reclining chaise lounge with the back panel in an upright position and a perspective view of the reclining chaise lounge with the back panel in a reclined position, respectively. The reclining chaise lounge 10 comprises a base frame 16 having a front portion 11 and a rear portion 13. A seat panel 12 is secured to the front portion 11 and further comprises a planar surface on which a user may sit. A back panel 14 is hingedly secured to the base frame 16 at an intermediate position between the front portion 11 and the rear portion 13 of the base frame 16, where the back panel 14 provides a support surface on which users may rest their backs when seated or reclined thereon. In some embodiments, the seat panel 12 further comprises an extendible section 25, allowing a user to adjust the length of the seat panel 12.

The back panel 14 is operably connected to a seat reclining mechanism that is configured to adjust the angle of the back panel 14 relative to the seat panel 12. Additionally, the seat reclining mechanism is adapted to bias the back panel 14 toward a forward position, as shown in FIG. 1, wherein in the forward position the back panel 14 is approximately perpendicular relative to the seat panel 12.

A front leg 18 is disposed at the front portion 11 of the base frame 16 and a rear leg 20 is disposed at the rear portion 20 thereof. The font leg 18 and rear leg 20 are pivotally attached to the base frame 16 and are configured to rotate between a folded position and an extended position. In the extended position the front and rear legs 18, 20 provide support for the base frame 16 and suspend the reclining chaise lounge 10 at a desired height above a ground surface.

In some embodiments, the reclining chaise lounge 10 further comprises arm rests 26 hingedly attached to the front portion 11 at a first end and to the back panel 14 at a second end. In other embodiments, the arm rests 26 are configured to lower as the back panel 14 reclines. In some of these embodiments, the arms rests 26 comprise a resting platform 24, pivotally attached to the back panel 14 at a rear point 27 and to an arm rest support member 28 at a front point. The length of the arm rest support member 28 is equal to the distance between the rear point 27 and the base frame 16. This ensures that the resting platform 24 of the arm rest 26 remains parallel the seat panel 12 as the back panel 14 reclines. This allows a user to comfortably rest their arms while lying in the reclining chaise lounge 10, even while the back panel 14 is secured in various reclined positions.

In some embodiments of the reclining chaise lounge 10, there is a canopy 22 secured to an upper end of the back panel 14. The canopy 22 is configured to extend from a collapsed position, as shown in FIG. 2, to a fully extended position, as shown in FIG. 1. The canopy 22 further can be adjusted in incremental positions between the collapsed and fully extended position, such that a user may adjust the canopy in various positions in order to cover his or her body as desired. The canopy includes a latch mechanism configured to temporarily secure the canopy 22 at these incremental positions between the collapsed and fully extended positions.

Figure 3:
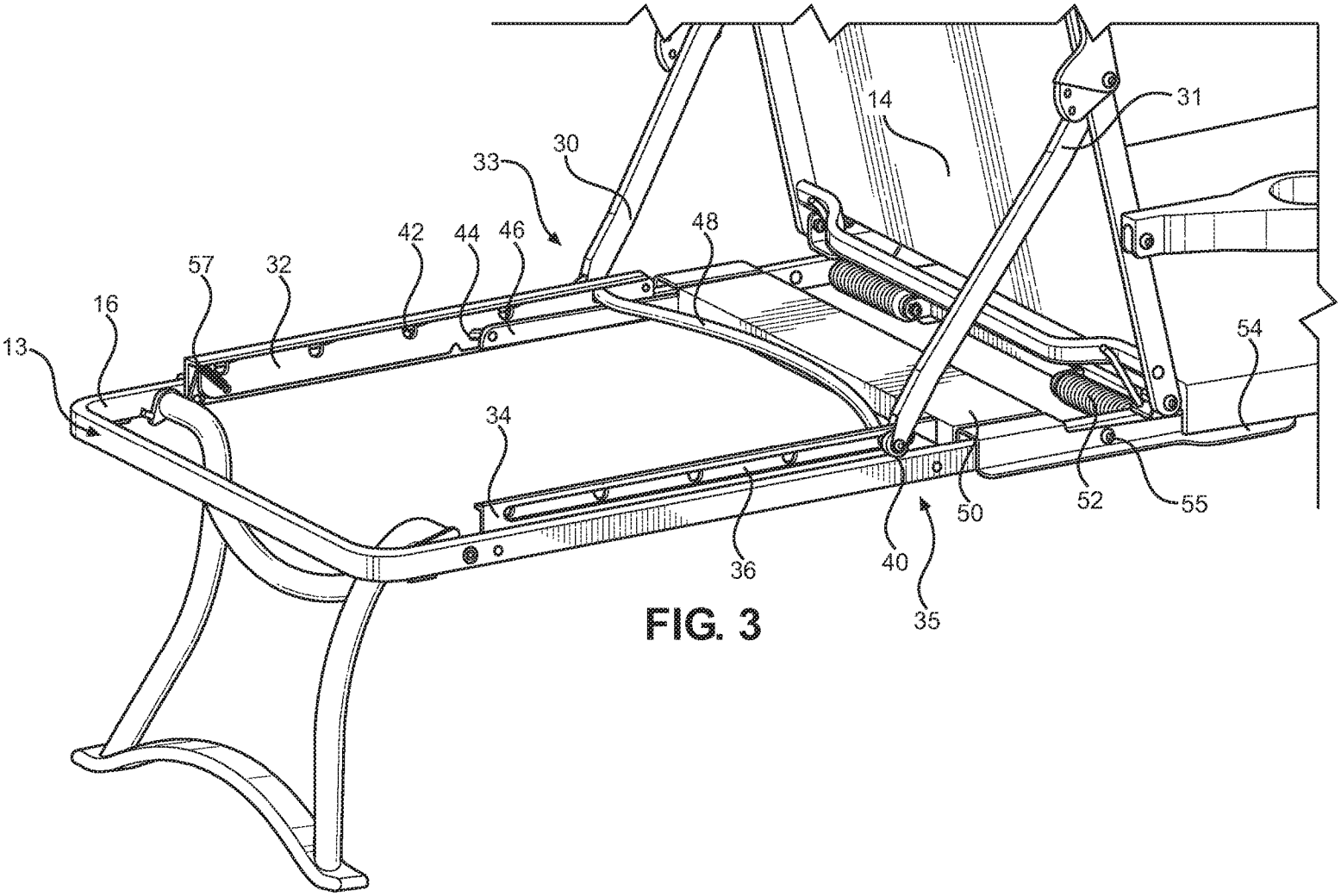
FIG. 3 shows a close-up view of the reclining mechanism of the reclining chaise lounge in a locked position.
Figure 4:
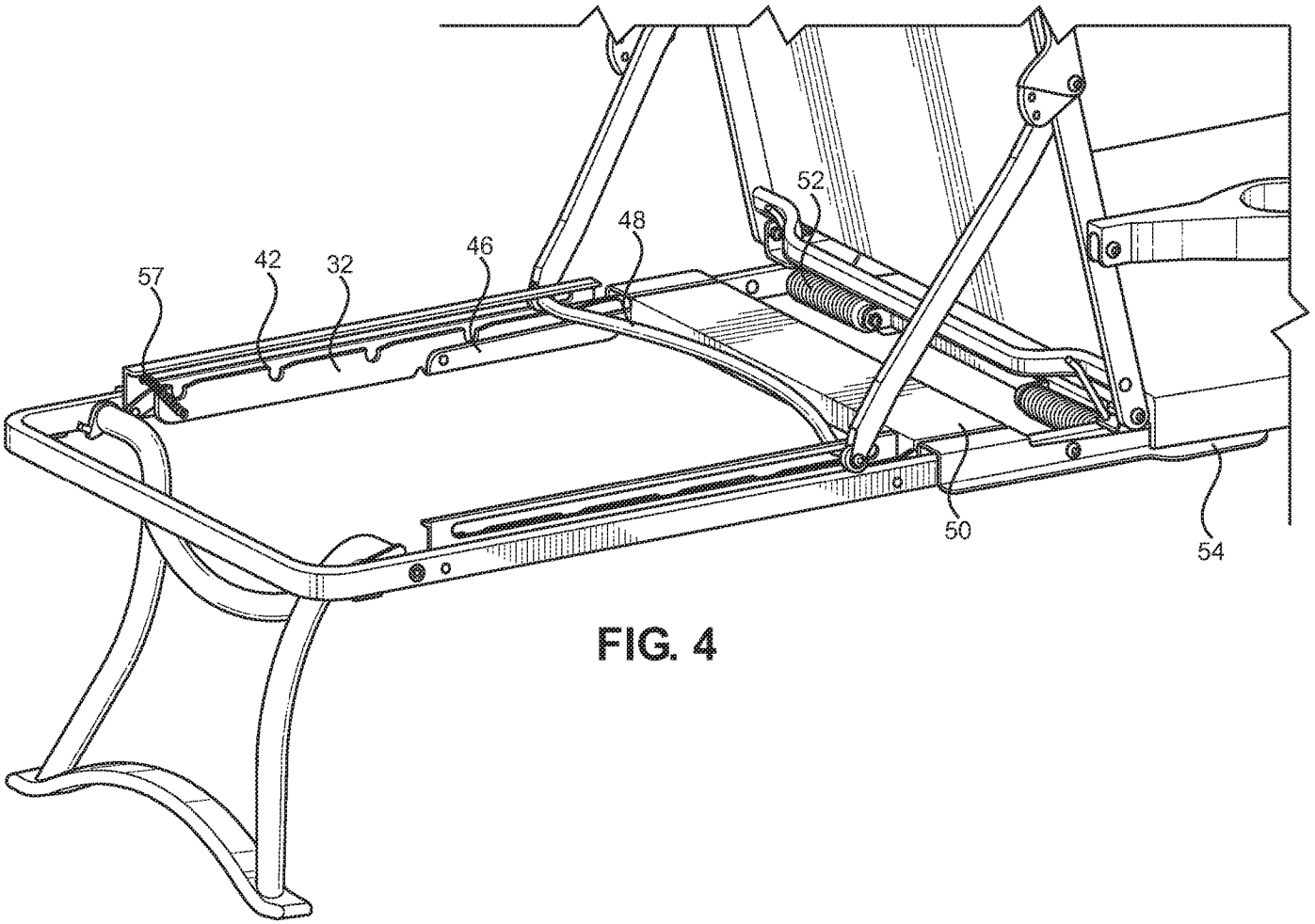
FIG. 4 shows a close-up view of the reclining mechanism of the reclining chaise lounge in an unlocked position.

Referring now to FIGS. 3 and 4, there is shown a close-up view of the reclining mechanism of the reclining chaise lounge in a locked position and a close-up view of the reclining mechanism of the reclining chaise lounge in an unlocked position. The reclining mechanism comprises a pair of support brackets, wherein a first support bracket 30 is disposed on a first side 33 of the base frame 16 and a second support bracket 31 is disposed on an opposing second side 35 of the base frame 16. The pair of support brackets 30, 31 are connected via a cross member 48 that spans therebetween. Each of the pair of support brackets 30, 31 connect the back panel 14 to a corresponding pair of tracks disposed on the rear portion 13 of the base frame 16. In this manner, the support brackets 30, 31 maintain the back panel 14 at a desired angle relative to the seat panel and the base frame 16.

Each of the pair of tracks comprises an elongated member 34 disposed longitudinally along the first side 33 and second side 35 of the base frame 16. Each elongated member 34 includes a slot 36 disposed longitudinally along a linear length thereof, and a latch member 32 slidably coupled thereto. The latch member 32 is positioned parallel relative to the elongated member 34 and is configured transition between a locked position, as shown in FIG. 3, and an unlocked position, as shown in FIG. 4, via a release mechanism. Each of the pair of support brackets 30, 31 are configured to be selectively positioned within one or more recessed notches 42 that are disposed at intervals along the latch member 32. The one or more recessed notches 42 receive the support brackets 30, 31 therein, and position them along the elongated members 34, thereby securing the back panel 14 at a specific angle relative to the base frame 16. The back panel 14 is secured to the base frame 16 when the cross member 48 is secured within one of the selected recessed notches 42 and the latch member 32 is moved into the locked position. In some embodiments, the support brackets 30, 31 each include rollers 40 positioned lateral to each of the slots 36, wherein the rollers 40 are configured for sliding engagement within each of the respective tracks, allowing for smooth movement of the support brackets 30, 31 along the length of the slot 36.

When a user desires to adjust the angel of the back panel 14, a paddle 54 disposed beneath the seat panel is engaged. The paddle 54 is connected to the latch member 32 via a central beam 50 having a pivot point 55 disposed between the paddle 54 and the latch member 32, thus creating a first degree lever. Pulling upward on the paddle 54 pushes downwards on a lever arm 46 that is configured to lower the latch member 32 and release the cross member 48 from the recessed notches 42. This allows the support brackets 30, 31 to slide along the slot a new position along the elongated members 34. When a user releases the paddle 54, a spring 57 applies an upward force to the latch member 32, locking the cross member 48 within the one of the recessed notches 42 on either side of the base frame 16.

Additionally, the back panel 14 of the reclining chaise lounge 10 is biased towards a forward position, or towards the front portion of the reclining chaise lounge. In some embodiments, the back panel 14 is connected to a torsion spring 52 that is secured to the base frame 16 and at intermediate position therealong. When the latch member 42 is released via the paddle 54 and no opposing force is placed on the back panel 14, the torsion spring 52 biases the back panel 14 to the forward position. Conversely, when a user wishes to move the back panel 14 towards a reclined position, the user simply engages the paddle 54 and leans back against the back panel 14. The back panel 14 lowers when the force applied by the user to the back panel 14 is greater than the force exerted thereupon by the torsion spring 52.

Figure 5:
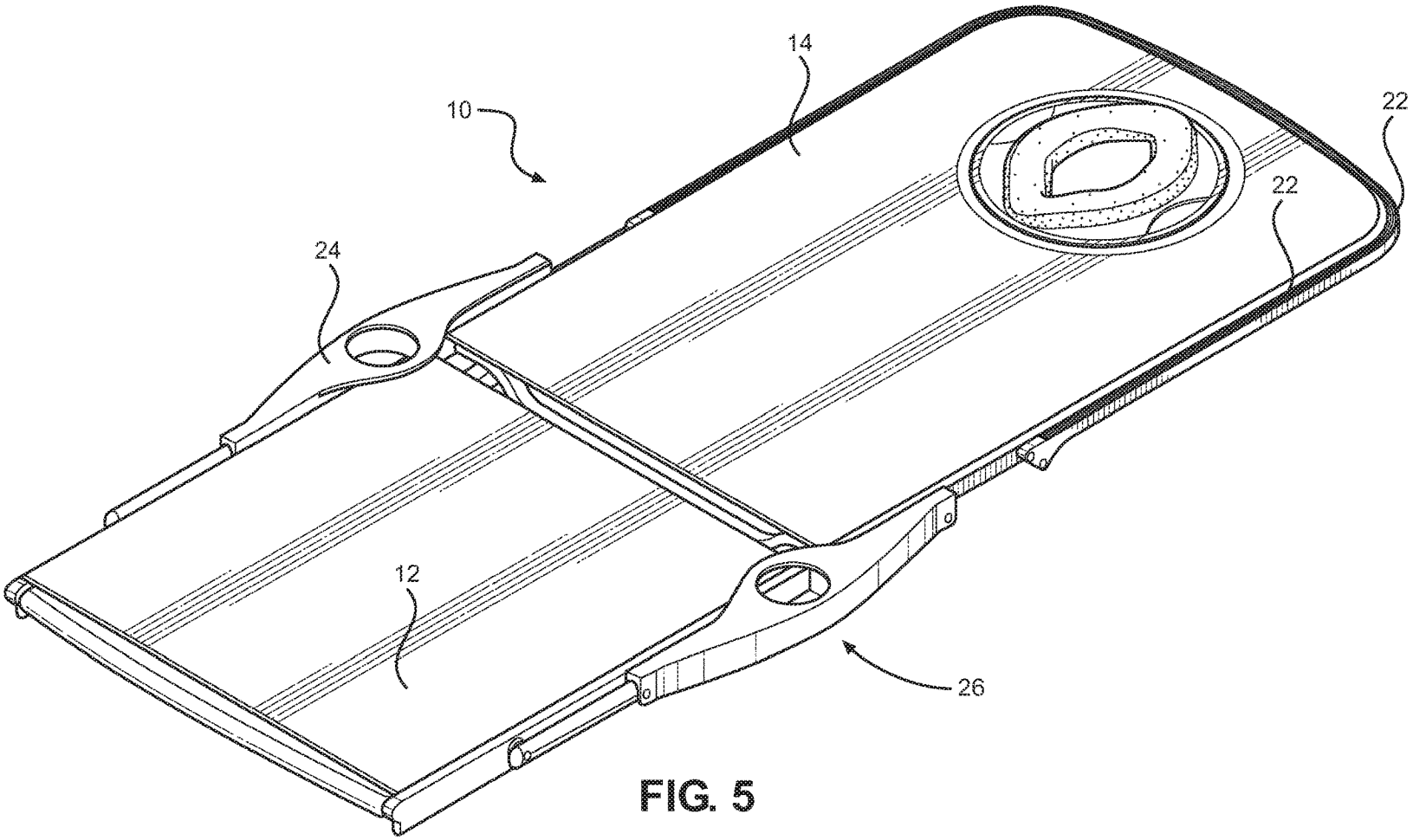
FIG. 5 shows a top perspective view of the reclining chaise lounge folded in a flat position.
Figure 6:
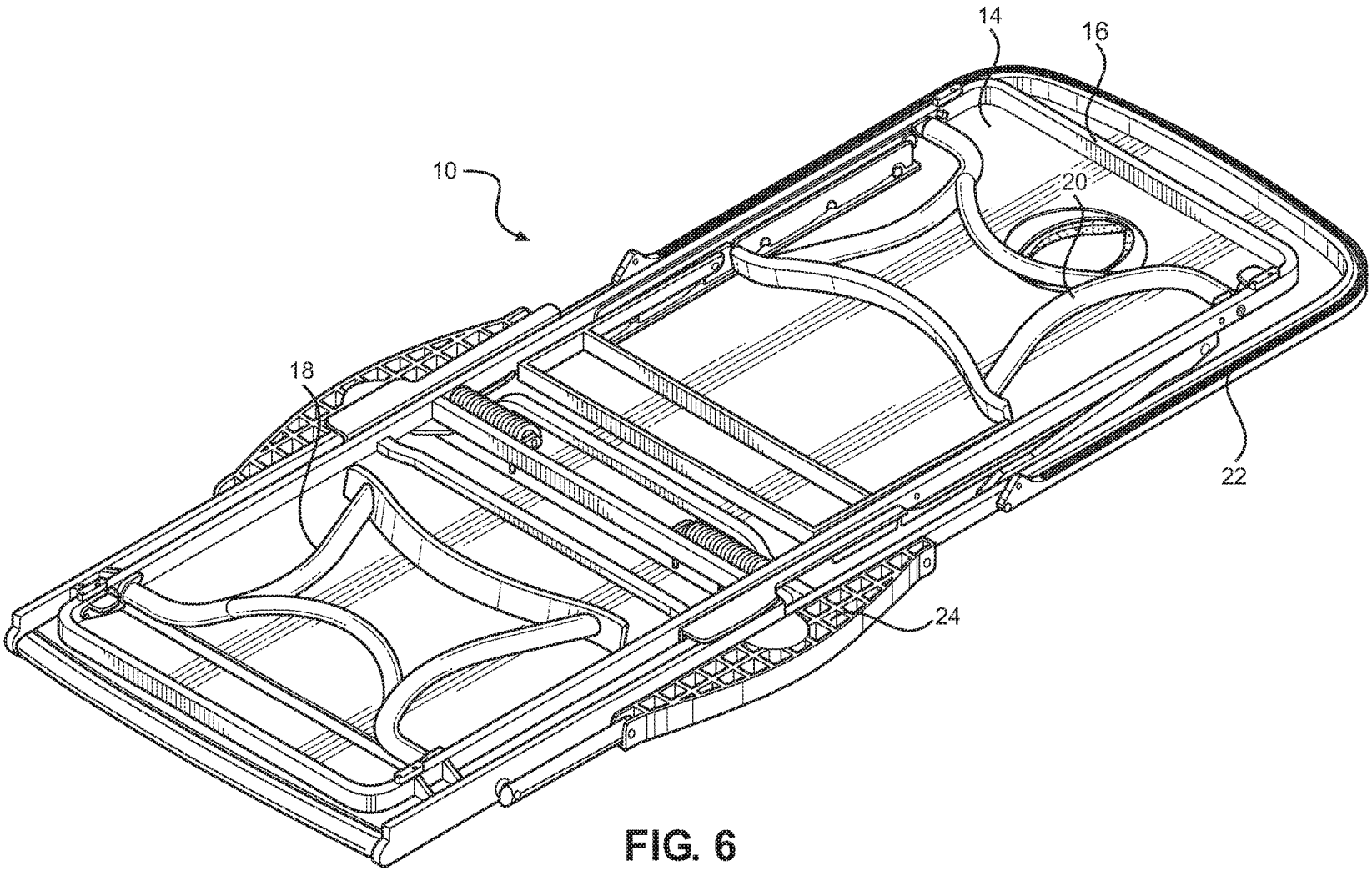
FIG. 6 shows a bottom perspective view of the reclining chaise lounge folded in a flat position.

Referring now to FIGS. 5 and 6, there is shown a top perspective view of reclining chaise lounge folded in a flat position and a bottom perspective view of reclining chaise lounge folded in a flat position, respectively. The reclining chaise lounge 10 is configured to collapse into a flat state, allowing for efficient and convenient storage. The back panel 14 is dimensioned to lie flat within the base frame 16 when extended toward a fully reclined position. Additionally, both the front leg 18 and the rear leg 20 are configured to rotate toward a stowed position, where both are nestled within the base frame 16, as shown in FIG. 6. In some embodiments of the reclining chaise lounge 10, the front leg 18 and rear leg 20 additionally feature a locking mechanism, which prevents the rotation of the legs 18, 20 when in an extended position in order to safeguard the legs from accidentally folding when a user moves the reclining chaise lounge 10.

The arm rests 26 are additionally configured to move toward a fully reclined position, as shown in FIG. 5, where the resting platform 24 lies in a parallel plane with the seat panel 12 and the back panel 14, and is positioned flush with the base frame 16.

Figure 7A:
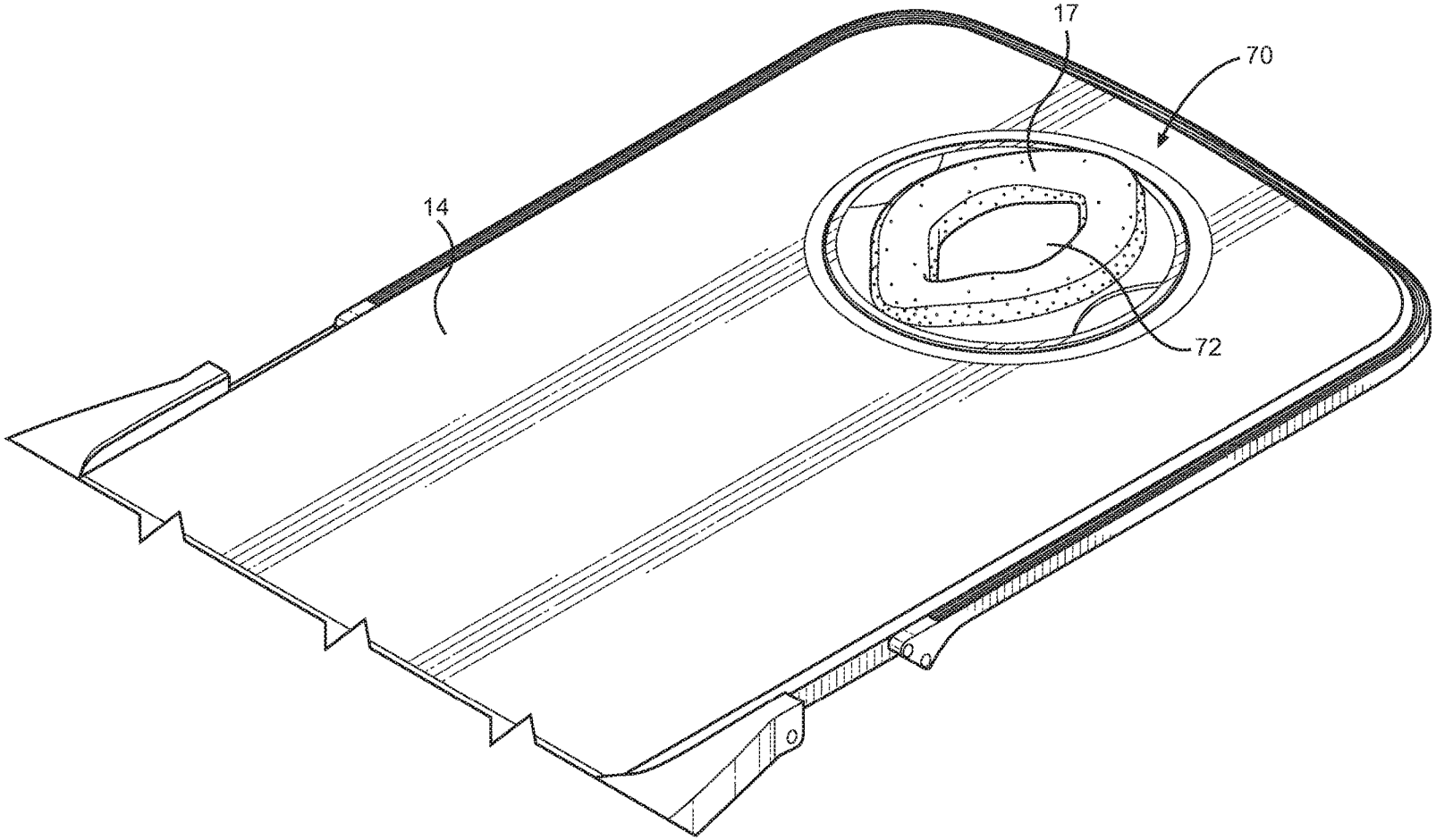
FIG. 7A shows a perspective view of the head rest of the reclining chaise lounge.
Figure 7B:
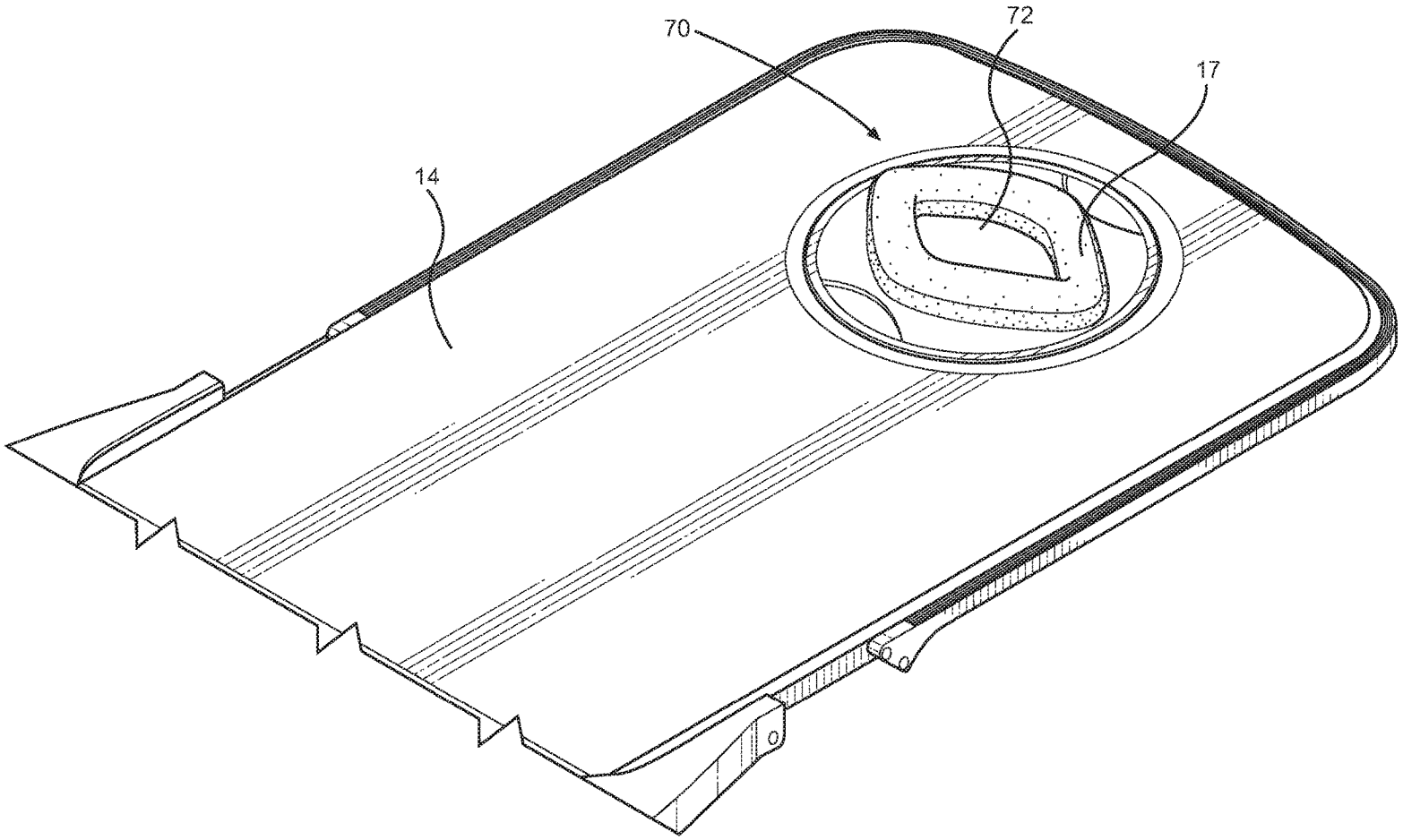
FIG. 7B shows a perspective view of the head rest of the reclining chaise lounge in a rotated position.

Referring now to FIGS. 7A and 7B, there are shown perspective views of the head rest of the reclining chaise lounge in an unrotated and rotated position respectively. The back panel 14 of the reclining chaise lounge 10 further includes a head rest 70 disposed on an upper end thereof. The head rest 70 includes an annular pillow 74 positioned in an opening 72 in the back panel 14. In some embodiments, the annular pillow 74 is rotatably coupled to the back panel 14, such that the annular pillow 74 may rotate within the opening 72 relative to the back panel 14. In one embodiment, the annular pillow 74 includes an oblong shape that enables a user to adjust the annular pillow 74, such that its longitudinal axis runs parallel or perpendicular to a top edge of the back panel 14. In another embodiment, the annular pillow 74 includes an opening therethrough. In this way, a user may use the annular pillow 74 in a variety of settings, such as placing the rear of their head within the pillow, or their face within the opening of the annular pillow 74 when lying face down on the reclining chaise lounge chair 10, as is employed with head pillows featured on conventional massage tables.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reclining chaise lounge, comprising:

a base frame comprising a front portion and a rear portion;

a seat panel secured to the base frame;

a back panel hingedly secured to the base frame adjacent to the seat panel, the back panel connected to a seat reclining mechanism configured to adjust an angle of the back panel relative to the seat panel;

wherein the seat reclining mechanism comprises a first support bracket and a second support bracket, wherein the first support bracket and the second support bracket are interconnected by a cross member;

wherein the seat reclining mechanism further comprises:

a first track disposed on the rear portion, and a second track disposed on the rear portion, wherein the first track comprises a first elongated member comprising a first slot extending longitudinally thereof, wherein the second track comprises a second elongated member comprising a second slot extending longitudinally thereof, wherein the cross member is slidably disposed within the first slot and the second slot;

a latch member pivotally affixed to the first elongated member; wherein the latch member is configured to transition between a locked position and an unlocked position by a release mechanism;

wherein one or more recessed notches are disposed along the latch member, wherein the one or more recessed notches are sized to receive the cross member therein;

wherein in the locked position the latch member engages the cross member and secures the cross member within a selection of the one or more recessed notches;

wherein in the unlocked position the cross member is released from the selection of the one or more recessed notches and is configured to slidably transition along the first slot and the second slot;

a bias mechanism secured to the back panel, the bias mechanism biasing the back panel towards a forward position.

2. The reclining chaise lounge of claim 1, wherein the first support bracket comprises a first roller positioned lateral to the first slot, and the second support bracket comprises a second roller positioned lateral to the second slot, wherein the first roller is configured to slidably engage with the first track, wherein the second roller is configured to slidably engage with the second track.

3. The reclining chaise lounge of claim 1, wherein in the forward position the back panel is positioned approximately perpendicular relative to the seat panel.

4. The reclining chaise lounge of claim 1, wherein the release mechanism comprises:

a lever pivotally attached to the base frame, the lever including a front end and a rear end;

a paddle disposed on the front end;

a central beam disposed on the rear end;

wherein the lever is configured to disengage the latch member from the cross member via the central beam and release the cross member from the one or more recessed notches, upon engagement of the paddle.

5. The reclining chaise lounge of claim 4, wherein the paddle is positioned underneath the seat panel.

6. The reclining chaise lounge of claim 1, wherein the bias mechanism comprises a torsion spring applying a rotational bias between the base frame and the back panel.

7. The reclining chaise lounge of claim 1, further comprising a front leg and a rear leg, wherein the front leg and the rear leg are hingedly attached to the base frame.

8. The reclining chaise lounge of claim 1, further comprising a front leg and a rear leg, wherein the front leg, the rear leg and the back panel are configured to fold into the base frame, such that the front leg, the rear leg, and the back panel each lies flush within the base frame when in a folded position.

9. The reclining chaise lounge of claim 1, further comprising a first arm rest hingedly attached at a first end thereof to the front portion of the base frame and at a second end thereof to the back panel, and a second arm rest hingedly attached at a first end thereof to the front portion of the base frame and at a second end thereof to the back panel.

10. The reclining chaise lounge of claim 9, wherein the first arm rest is configured to lower as the back panel reclines, and wherein the second arm rest is configured to lower as the back panel reclines.

11. The reclining chaise lounge of claim 1, further comprising a canopy attached to an upper end of the back panel.

12. The reclining chaise lounge of claim 11, wherein the canopy is configured to be incrementally adjusted to various intermediate positions between an extended position and a retracted position.

13. The reclining chaise lounge of claim 1, further comprising a head rest disposed on an upper end of the back panel, the head rest comprising an opening in the back panel having an annular pillow inserted therein.

14. The reclining chaise lounge of claim 13, wherein the pillow is rotatable within the opening relative to the back panel.

15. The seat reclining mechanism of claim 1, wherein the latch member is pivotally affixed to the second elongated member.

16. The seat reclining mechanism of claim 1, wherein the latch member is pivotally affixed to a combination of the first and second elongated members.

17. The seat reclining mechanism of claim 1, wherein the first support bracket is disposed on a first side of the base frame, wherein the second support bracket is disposed on a second side of the base frame, wherein the first side of the base frame and the second side of the base frame are opposite to each other.

18. The reclining chaise lounge of claim 1, wherein the seat panel further comprises an extendable section allowing the seat panel to have an adjustable length.

19. A seat reclining mechanism comprising:

a first support bracket and a second support bracket, wherein the first support bracket and the second support bracket are interconnected by a cross member, wherein the first support bracket is disposed on a first side of a base frame, wherein the second support bracket is disposed on a second side of the base frame, wherein the first side of the base frame and the second side of the base frame are opposite to each other;

a first track disposed on a rear portion, and a second track disposed on the rear portion, wherein the first track comprises a first elongated member comprising a first slot extending longitudinally thereof, wherein the second track comprises a second elongated member comprising a second slot extending longitudinally thereof, wherein the cross member is slidably disposed within the first slot and the second slot;

a latch member pivotally affixed to at least the first elongated member; wherein the latch member is configured to transition between a locked position and an unlocked position by a release mechanism;

wherein one or more recessed notches are disposed along the latch member, wherein the one or more recessed notches are sized to receive the cross member therein;

wherein in the locked position the latch member engages the cross member and secures the cross member within a selection of the one or more recessed notches;

wherein in the unlocked position the cross member is released from the selection of the one or more recessed notches and is configured to slidably transition along the first slot and the second slot;

a bias mechanism secured to a back panel, the bias mechanism biasing the back panel towards a forward position.

20. The seat reclining mechanism of claim 19, wherein the first support bracket comprises a first roller positioned lateral to the first slot, and the second support bracket comprises a second roller positioned lateral to the second slot, wherein the first roller is configured to slidably engage with the first track, wherein the second roller is configured to slidably engage with the second track.

21. The seat reclining mechanism of claim 19, wherein the release mechanism comprises:

a lever pivotally attached to the base frame, the lever including a front end and a rear end;

a paddle disposed on the front end;

a central beam disposed on the rear end;

wherein the central beam is connected to the latch member;

wherein the lever is configured such that upon engagement of the paddle, the latch member disengages from the cross member.

22. The seat reclining mechanism of claim 19, wherein the bias mechanism comprises a torsion spring applying a rotational bias between the base frame and the back panel.

23. The seat reclining mechanism of claim 19, wherein the latch member is pivotally affixed to the second elongated member.

* * * * *